US007195525B2

(12) United States Patent
Watabe et al.

(10) Patent No.: US 7,195,525 B2
(45) Date of Patent: Mar. 27, 2007

(54) OUTBOARD MOTOR

(75) Inventors: Hiroshi Watabe, Saitama (JP); Yoshio Ohtomo, Saitama (JP); Yoshihisa Hirose, Saitama (JP)

(73) Assignee: Honda Motor Co., Ltd, Tokyo (JP)

( * ) Notice: Subject to any disclaimer, the term of this patent is extended or adjusted under 35 U.S.C. 154(b) by 0 days.

(21) Appl. No.: 11/402,116

(22) Filed: Apr. 11, 2006

(65) Prior Publication Data

US 2006/0228956 A1 Oct. 12, 2006

(30) Foreign Application Priority Data

Apr. 12, 2005 (JP) ..... 2005-114864

(51) Int. Cl.
*B60L 11/00* (2006.01)

(52) U.S. Cl. ..... 440/6

(58) Field of Classification Search ..... 440/6
See application file for complete search history.

(56) References Cited

U.S. PATENT DOCUMENTS 3,580,212 A * 5/1971 Fortson ..... 440/6
5,669,323 A * 9/1997 Pritchard ..... 114/183 R

FOREIGN PATENT DOCUMENTS

JP 63-158493 10/1988
JP 10-37780 2/1998

* cited by examiner

*Primary Examiner*—Stephen Avila
(74) *Attorney, Agent, or Firm*—Carrier, Blackman & Associates, P.C.; Joseph P. Carrier; William D. Blackman

(57) ABSTRACT

In an outboard motor adapted for mounting on a boat and equipped with an internal combustion engine, an electric motor, a battery for supplying voltage to the engine and electric motor, and a controller for controlling the operation of the electric motor, the controller is disposed near the battery. In other words, the controller is not installed on the outboard motor side where the engine and the like are present but on the boat side where the battery is installed. As a result, the effect of the vibration and heat of the engine on the controller is minimized so that the controller can utilize simpler structural features for vibration and heat resistance and is also advantageous in terms of cost.

16 Claims, 5 Drawing Sheets

IGNITION CKT.
104
106
20
MODE SW
62
62a
62b
EMER SW
64
56
60
110
96a
96b
96
98b
98
98a
112
BLM
28
UVW
SENSOR
OUTBOARD MOTOR SIDE
BOAT (BATTERY BOX) SIDE
86
KEY IN
VCC
SPEED
Sig GND
EMER SW
EMER GND
Bat
RELAY
GND
CONTROLLER
SUB FUSE
92a
92b
94a
94
94b
MAIN FUSE
90
82

OUTBOARD MOTOR

BACKGROUND OF THE INVENTION

1. Field of the Invention

This invention relates to an outboard motor, particularly to a hybrid outboard motor equipped with an internal combustion engine and an electric motor which are used as power sources for driving a propeller.

2. Description of the Related Art

Hybrid outboard motors adapted for mounting on a boat and equipped with an engine and a motor used as power sources for driving a propeller have been developed in a variety of types, as taught, for example, by Japanese Laid-Open Utility Model Application No. Sho 63(1988)-158493, particularly FIGS. 1 and 4.

In such an outboard motor, an electronic control unit or controller for controlling the operation of either or both of the engine and the motor is, as shown in Japanese Laid-Open Patent Application No. Hei 10(1998)-37780, particularly FIG. 3, installed on the outboard motor, namely, inside the outboard motor.

Owing to the fact that the engine installed in the outboard motor generates vibration and heat, the mounting structure of the electronic control unit and the devices used in its electronic circuitry have to be made capable of withstanding vibration, heat and other harsh environment conditions. The electronic control unit therefore becomes complex in structure and high in cost. In addition, installation of the electronic control unit inside the outboard motor is inconvenient because the limited interior space of the outboard motor leaves little mounting layout freedom.

SUMMARY OF THE INVENTION

An object of this invention is therefore to overcome the foregoing inconveniences by providing an outboard motor whose electronic control unit achieves required vibration and heat resistance with a simple structure and helps to enhance mounting layout freedom.

In order to achieve the object, this invention provides an outboard motor mounted on a stern of a boat and having an internal combustion engine and a propeller to be powered by the engine to propel the boat, comprising: an electric motor installed to be operable to rotate the propeller; a battery installed in the boat for supplying voltage to the engine and the electric motor; and a controller installed at a position near the battery for controlling operation of at least one of the engine and the electric motor.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

An outboard motor according to a preferred embodiment of the present invention will now be explained with reference to the attached drawings.

Figure 1:
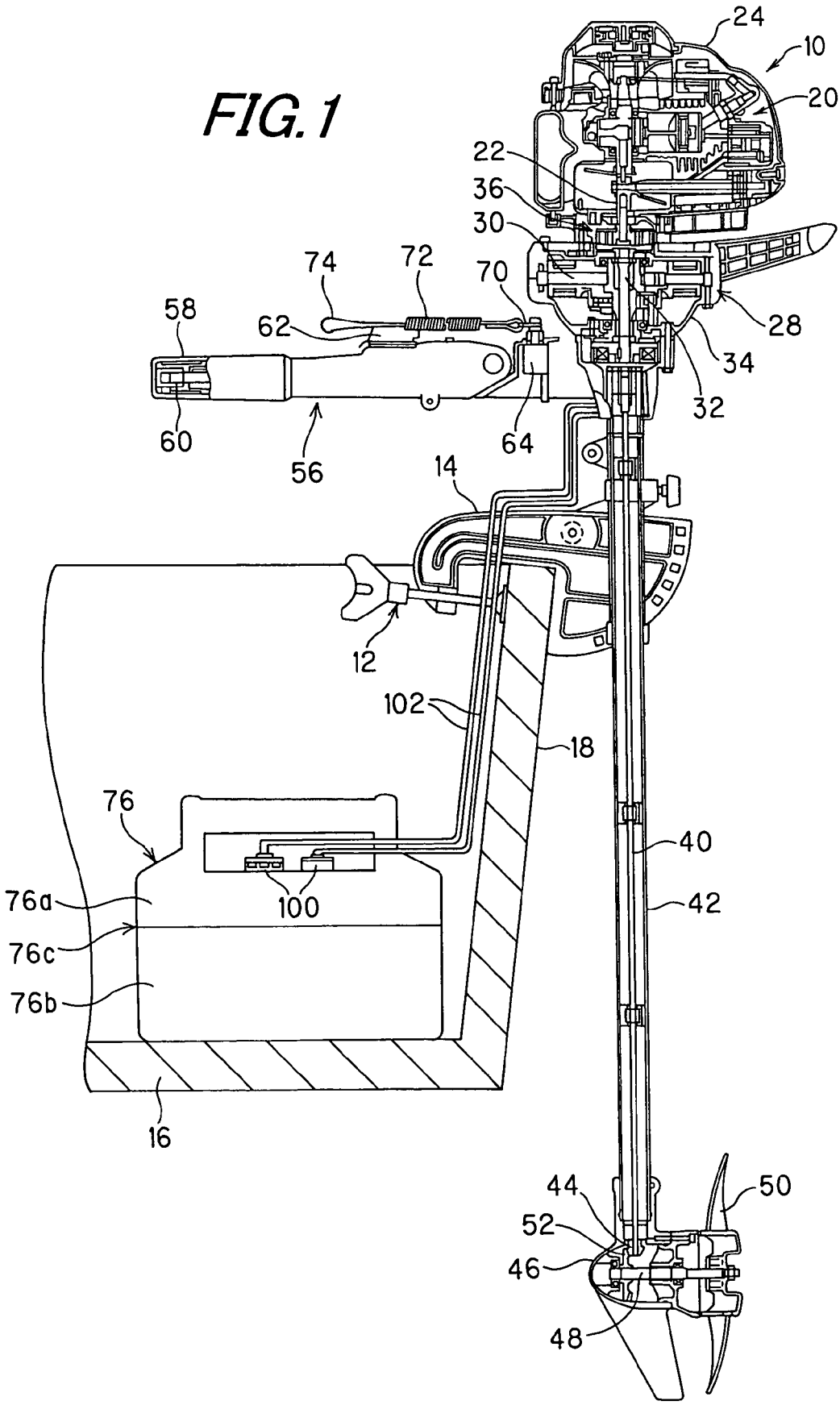
FIG. 1 is a partially sectional view of an outboard motor according to a preferred embodiment of the invention.

FIG. 1 is a partially sectional view of the outboard motor according to the preferred embodiment of the invention.

The outboard motor is designated by reference numeral 10 in FIG. 1. The outboard motor 10 is mounted on the stern (transom) 18 of a boat or hull 16 by means of two stern brackets 14 (only one shown in FIG. 1) equipped with a screw-type clamping device 12.

The outboard motor 10 is equipped with an internal combustion engine (power source; hereinafter called "engine") 20 at its upper portion in the vertical direction. The engine 20 is a one-cylinder gasoline engine with a displacement of about 50 cc. As shown in the drawing, the engine 20 has its crankshaft (output shaft) 22 aligned parallel to the vertical direction. The engine 20 and crankshaft 22 are enclosed by an engine cover 24.

As termed hereinafter, "vertical direction" means a direction parallel or substantially parallel to the crankshaft 22 and may differ from the gravity direction depending on the tilt angle or trim angle of the outboard motor 10. "Horizontal direction" means a direction orthogonal to the so-defined vertical direction. The horizontal direction looking toward the boat 16 from the outboard motor 10, i.e., the direction of forward travel, is defined as "forward" and the direction opposite thereof as "rearward." A horizontal direction orthogonal to the forward/rearward direction is called a "lateral direction" (i.e., left/right direction).

An electric motor (power source; generator-motor) 28 is installed in the outboard motor 10 vertically downward of the engine 20. The motor 28 is a DC brushless motor comprising a stator 30 and a rotor (output shaft) 32 that produces an output of several hundred Watts. As illustrated, the electric motor 28 has its rotor 32 aligned parallel to the vertical direction and is enclosed by a motor cover 34.

A centrifugal clutch 36 is installed between the engine 20 and the motor 28. Specifically, the lower end of the crankshaft 22 of the engine 20 and the upper end of the rotor 32 of the motor 28 are connected through the centrifugal clutch 36.

The upper end of a drive shaft 40 is connected to the lower end of the rotor 32 of the motor 28. As shown in the drawing, the drive shaft 40 is aligned parallel to the vertical direction and is supported within a drive shaft cover 42 to be rotatable around its vertical axis. A pinion gear 44 provided on the lower end of the drive shaft 40 is accommodated in a gear case 46 connected to the bottom of the drive shaft cover 42.

A propeller shaft 48 is supported within the gear case 46 to be rotatable around its horizontal axis. One end of the propeller shaft 48 extends out of the gear case 46 to project rearward of the outboard motor 10. A propeller 50 is attached to the projecting end. A bevel gear 52 installed on the outer periphery of the propeller shaft 48 meshes with the pinion gear 44 to be rotated thereby.

The output (rotational output) of the motor 28 is transmitted through the drive shaft 40, pinion gear 44 and bevel gear 52 to the propeller shaft 48 to rotate the propeller 50, thereby producing thrust for driving the boat 16 forward or rearward.

The output (rotational output) of the engine 20 is transmitted through the centrifugal clutch 36 to the rotor 32 and then, like the output of the motor 28, through the drive shaft 40, pinion gear 44 and bevel gear 52 to the propeller shaft 48 to rotate the propeller 50, thereby producing thrust for driving the boat 16 forward or rearward. In other words, the propeller 50 is rotated by either or both of the output of the engine 20 and the output of the motor 28.

Thus the outboard motor 10 comprises a hybrid outboard motor mounted on the boat 16 that is equipped with the engine 20 and motor 28 as power sources. More specifically, it is a small outboard motor equipped with the engine 20 having a displacement of about 50 cc and the electric motor 28 having an output of several hundred Watts.

The outboard motor 10 is equipped with a bar handle 56 installed below the engine cover 24. As illustrated, the bar handle 56 projects from the motor cover 34 in the forward direction so as to be operable by the boat operator. The drive shaft cover 42 is supported by the stem brackets 14 to be rotatable around its vertical axis, so that the operator can steer or maneuver the outboard motor 10 left and right by swinging the bar handle 56 horizontally, more exactly, laterally.

The bar handle 56 is provided at its free end with a throttle grip 58 that can be rotated by the operator and that internally incorporates a rotation angle sensor or volume sensor 60 for outputting a signal indicative of the rotation angle (manipulated variable) of the throttle grip 58.

The throttle grip 58 is connected to the throttle valve (not shown) of the engine 20 through a push-pull cable (not shown). The operator can therefore manipulate the throttle grip 58 to adjust the opening of the throttle valve, thereby controlling the speed of the engine and, by this, the speed of the boat 16.

The bar handle 56 is further equipped with a mode switch 62 which the operator can use to input commands for starting and stopping the engine 20 and motor 28 and with an emergency shutdown switch 64 connected to the engine 20 and motor 28 that when manipulated shuts down both of them.

Although not shown in the drawings, the mode switch 62 has four positions: "Engine Power" for rotating the propeller 50 with power from the engine 20, "Motor Power" for rotating it with power from the electric motor 28, "Engine & Motor Power" for rotating it with power from both the engine 20 and motor 28, and "Engine & Motor CUTOFF" for cutting off supply of power to the propeller 50 from the engine 20 and motor 28. The operator can select any one of the four switch positions as desired. Depending on the position of the mode switch 62 selected by the operator, first and second movable switches (explained later) are turned ON or OFF.

A tab or lock plate 70 is detachably provided on the emergency shutdown switch 64 to serve as an ON/OFF trigger thereof. The tab 70 is connected to one end of an expandable spiral cord 72 whose other end has a fastener 74 attached thereto. Although not shown in the drawing, the fastener 74 is attached to the operator's wrist or waist. A watertight battery box 76 adapted to accommodate a battery (explained later) for supplying voltage to the engine 20 and motor 28 is removably installed or mounted at an appropriate location on the boat 16.

Figure 2:
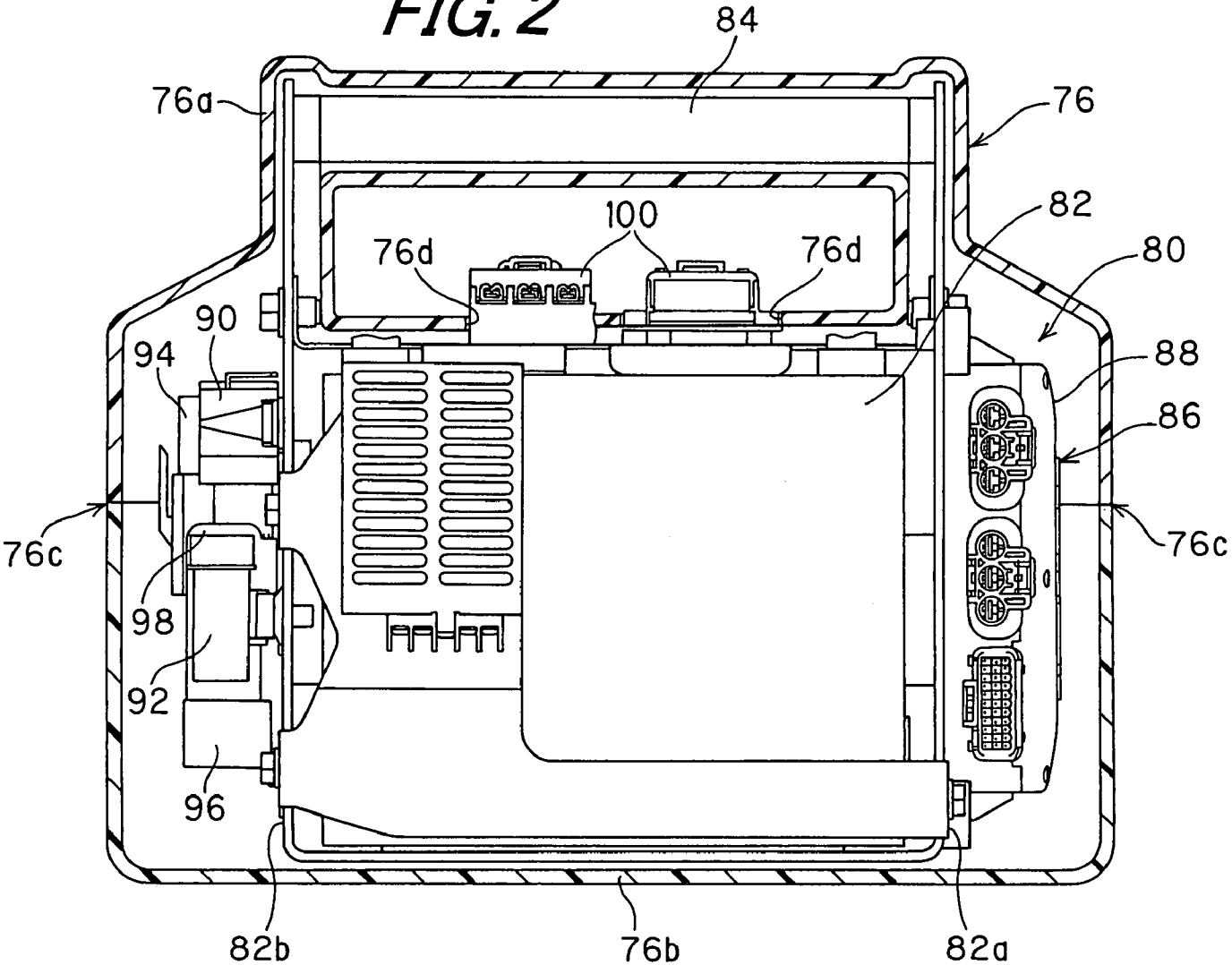
FIG. 2 is an enlarged sectional side view for explaining a battery box etc. shown in FIG. 1.
Figure 3:
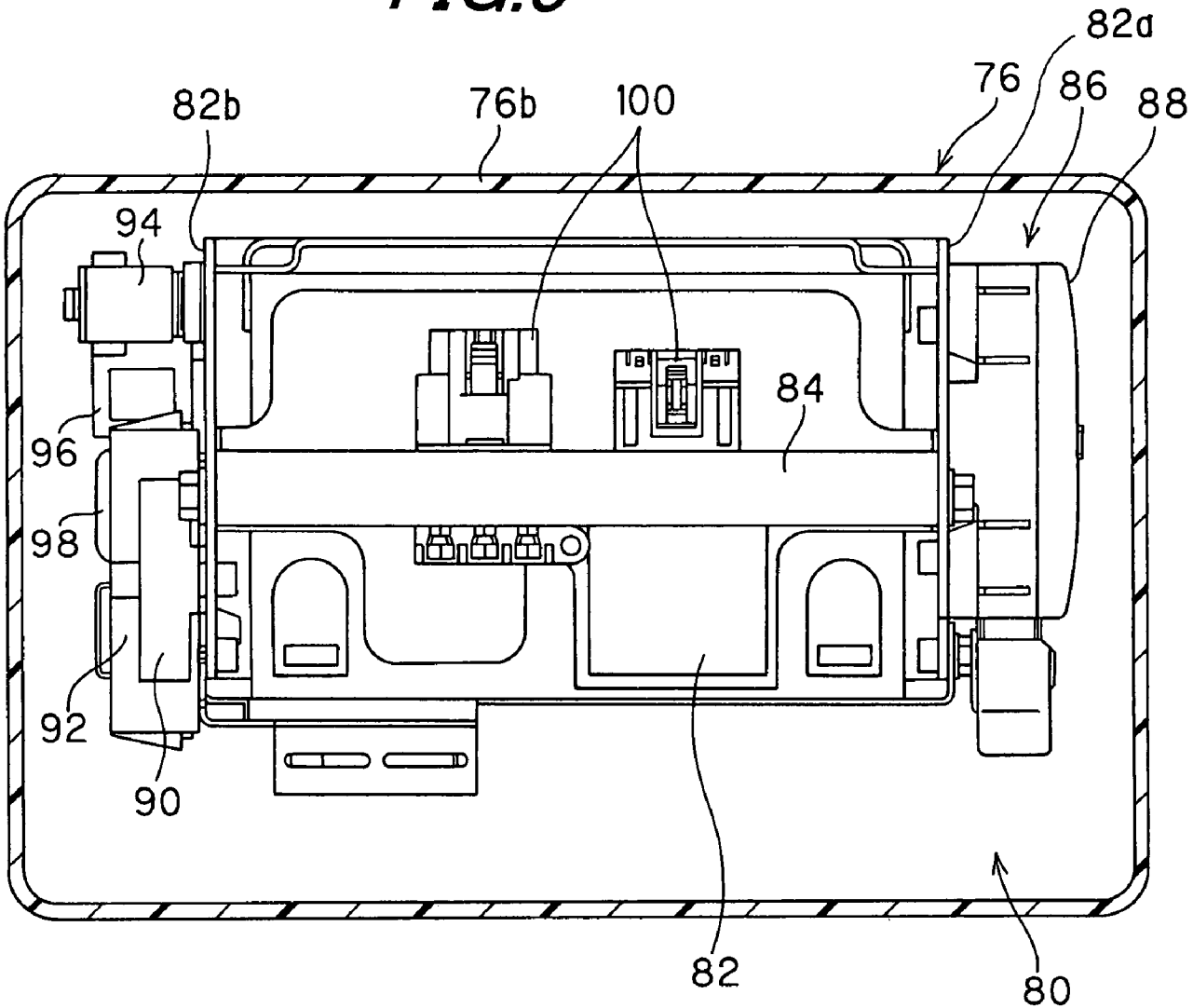
FIG. 3 is a plan view of a battery etc. shown in FIG. 2.
Figure 4:
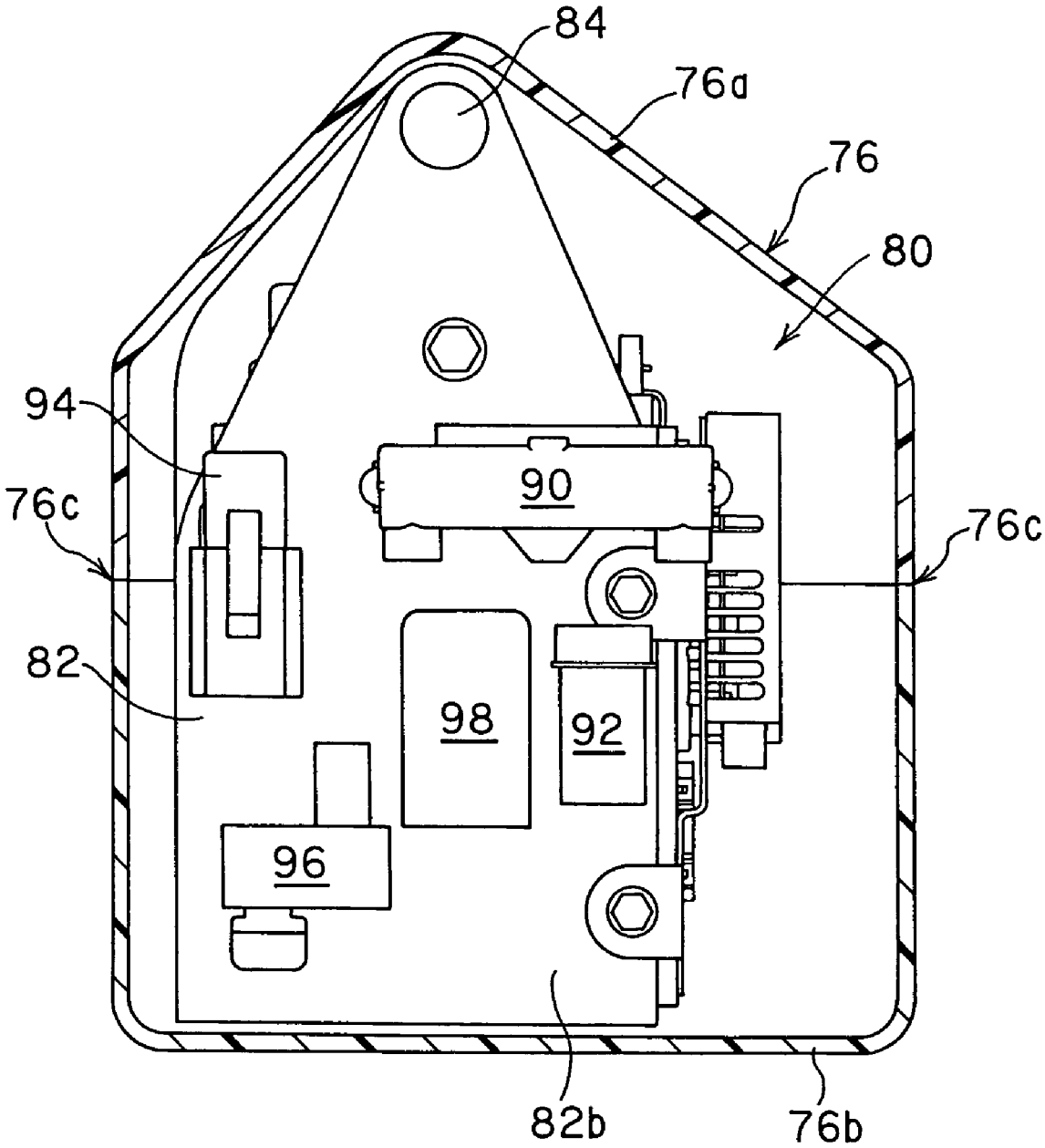
FIG. 4 is a side view of the battery etc. shown in FIG. 2 viewed from the left side in FIG. 2.

FIG. 2 is an enlarged sectional side view for explaining the battery and battery box 76. FIG. 3 is a plan view of the battery etc. shown in FIG. 2, and FIG. 4 is a side view of the battery etc. shown in FIG. 2 as viewed from the left side in FIG. 2.

The battery box 76 is made of a resin material and has a split structure comprising a plurality of members, more precisely, two members in the illustrated example. The member disposed on the upper side in the vertical direction will be called the "upper member" and designated 76*a*. The one on the lower side will be called the "lower member" and designated 76*b*. FIG. 3 shows the battery etc. with the upper member 76*a* removed.

The upper member 76*a* and lower member 76*b* are intimately joined so as to leave no gap at their contact region 76*c*. This is for making the battery box 76 watertight and airtight, namely, waterproof. The upper member 76*a* is formed at suitable locations with a plurality of, more precisely, two in the illustrated example, mounting holes 76*d* (only one shown in FIG. 2) for mounting external connectors (explained later) of the battery.

The battery box 76 encloses an internal space 80. The aforesaid battery (output voltage: 12 V), designated 82, is installed near the center of the space 80. The top of the battery 82 is equipped with a grip 84 that can be easily grasped by, for example, the boat operator. When the battery 82 needs to be charged on land, the operator or a maintenance person picks it up by the grip 84 and carries it to the charging facility.

An electric motor control unit (hereinafter referred to as "controller") 86 for controlling the supply of power by the motor 28 is installed on a side 82*a* of the battery 82, i.e., on the right side as viewed in FIGS. 2 and 3. The controller 86 is equipped with, inter alia, a microcomputer comprising a ROM, RAM and CPU (none of which is shown) and a power circuit (current supply circuit; explained later) for supplying voltage to the motor 28. The controller 86 is housed in a controller case 88 having a simple waterproof structure.

On the side 82*b* opposite from the side 82*a*, i.e., the left side as viewed in FIGS. 2 and 3 are provided a main fuse 90 and sub-fuses 92 for protecting peripheral equipment (electronic circuitry explained later) from overcurrent, a main relay (motor power relay) 94 that operates in response to the selected position of the mode switch 62, and a motor emergency relay 96 and engine emergency relay 98 that operate in response to the ON/OFF position of the emergency shutdown switch 64. This installation of the controller 86 on the side 82*a* of the battery 82 and the peripheral equipment (i.e., the main fuse 90 and the like) on the opposite side 82*b* helps to keep the weight of the battery 82 in balance.

On the upper surface of the battery 82 are mounted a plurality of, precisely, two in the illustrated example, external connectors 100 for outputting voltage from the battery 82, signals from the controller 86 and the like to peripheral equipment (e.g., the engine 20, motor 28, mode switch 62 of the bar handle 56 and emergency shutdown switch 64). As best shown in FIG. 2, the external connectors 100 are mounted to be exposed via the mounting holes 76*d* of the battery box 76. As shown in FIG. 1, one ends of a plurality of, two in the illustrated example, cables 102 are connected to the external connectors 100 and the other ends thereof are connected to the aforesaid peripheral equipment.

The structure of the outboard motor 10, particularly the controller 86, emergency shutdown switch 64 and the like thereof, will now be explained with reference to FIG. 5.

Figure 5:
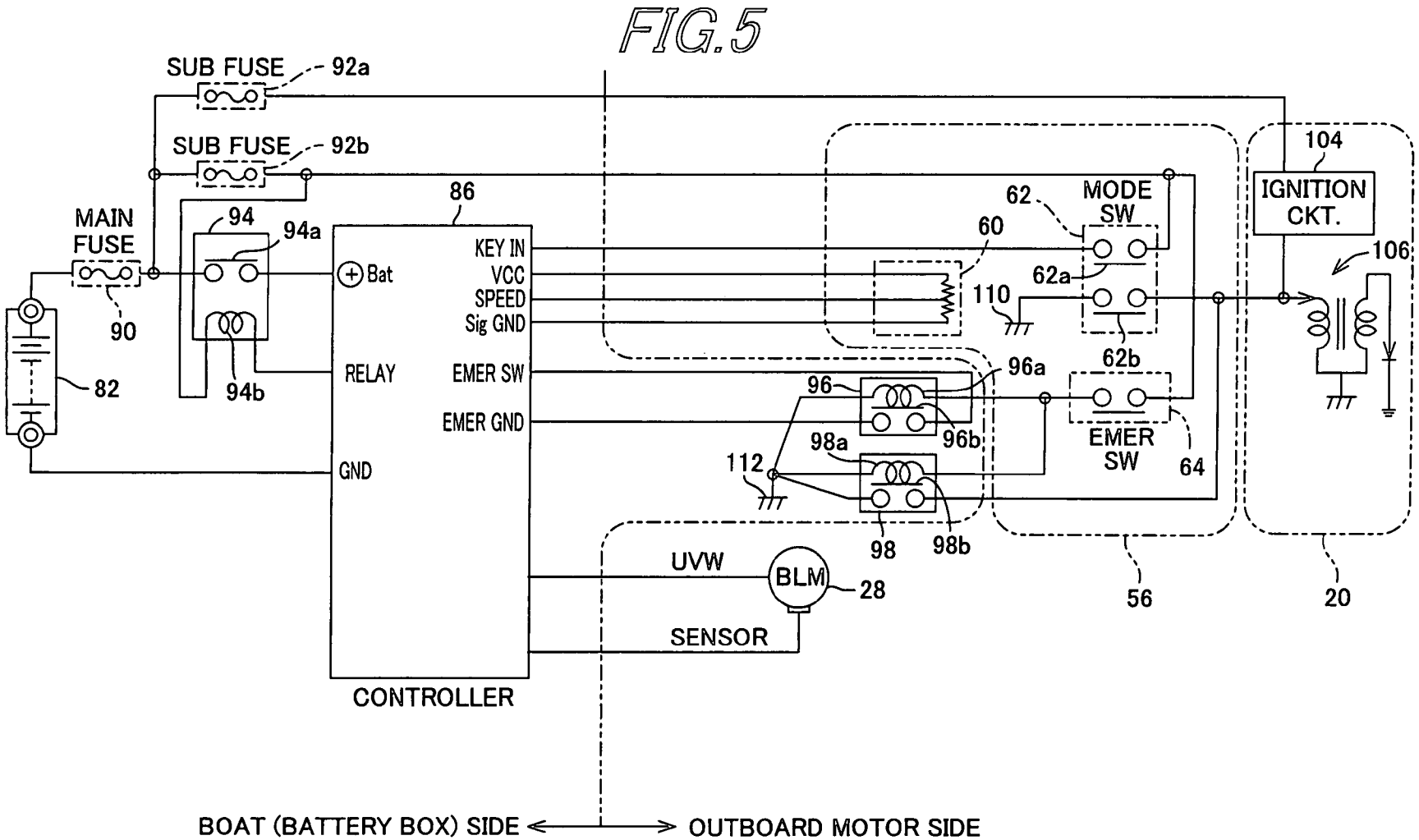
FIG. 5 is a system diagram of the outboard motor equipped with a controller, emergency shutdown switch and the like shown in FIGS. 1 and 2.

FIG. 5 is a system diagram of the outboard motor equipped with the controller 86, emergency shutdown switch 64 and the like.

The negative terminal of the battery 82 is connected to the GND (ground) terminal of the controller 86 and the positive terminal thereof is connected to the Bat (battery) terminal of the controller 86 through the main fuse 90 (designated MAIN FUSE in FIG. 5) and a movable switch 94*a* of the main relay 94.

One ends of a first sub-fuse 92*a* and a second sub-fuse 92*b* (both designated SUB FUSE in FIG. 5) are connected to a point between the main fuse 90 and the movable switch 94*a*. The other end of the first sub-fuse 92*a* is connected through an ignition circuit (current supply circuit) 104 to an ignition coil 106 of the engine 20. The other end of the second sub-fuse 92*b* is connected to the emergency shutdown switch 64 (designated EMER SW in FIG. 5).

One end of an exciting coil 94*b* of the main relay 94 is connected to a relay terminal of the controller 86 and the other end thereof is connected to a point between the second sub-fuse 92*b* and the emergency shutdown switch 64.

The mode switch 62 (designated MODE SW in FIG. 5), more specifically one end of a first movable switch 62*a* of the mode switch 62, is connected to a point between the second sub-fuse 92*b* and the emergency shutdown switch 64. The other end of the first movable switch 62*a* is connected to a KEY IN terminal of the controller 86. The mode switch 62 is further equipped with a second movable switch 62*b* whose one end is, as illustrated, connected to a ground terminal 110 and other end is connected to the ignition circuit 104 of the engine 20.

The emergency shutdown switch 64 is provided with at least two sets of contacts, to which the motor emergency relay 96 and engine emergency relay 98, specifically one end of an exciting coil 96*a* of the motor emergency relay 96 and one end of an exciting coil 98*a* of the engine emergency relay 98, are connected. The other ends of the two exciting coils 96*a*, 98*a* are, as illustrated, both connected to a ground terminal 112.

One end of a movable switch 96*b* of the motor emergency relay 96 is connected to an EMER GND terminal of the controller 86 and the other end thereof is connected to an EMER SW terminal of the controller 86. One end of a movable switch 98*b* of the engine emergency relay 98 is connected to a point between the second movable switch 62*b* of the mode switch 62 and the ignition circuit 104 and the other end thereof is connected to the ground terminal 112.

The motor 28 (designated BLM in the drawing) is connected to the aforesaid power circuit (power supply circuit; not shown) of the controller 86. The rotation angle senor 60 is also connected to the controller 86 and supplies it with a signal representing the rotation angle of the throttle grip 58.

The operation of the outboard motor 10, particularly the operation of the controller 86 and emergency shutdown switch 64 will be explained. When the operator selects the "Engine & Motor Power" position of the mode switch 62, the first movable switch 62*a* of the mode switch 62 is turned ON and the second movable switch 62*b* thereof is turned OFF.

As a result, voltage from the battery 82 is supplied or applied to the KEY IN terminal of the controller 86 through the first movable switch 62*a*. In response, the controller 86 energizes the exciting coil 94*b* of the main relay 94, thereby turning ON the movable switch 94*a* to supply voltage from the battery 82 through the power circuit to the motor 28 and start the motor 28.

In addition, since the second movable switch 62*b* of the mode switch 62 is turned OFF, the ignition circuit 104 of the engine 20 is cut off from the ground terminal 110, so that voltage from the battery 82 is supplied to the ignition coil 106 through the ignition circuit 104. When this condition has been established, the operator can start the engine 20 by operating an unshown recoil starter.

When the "Engine Power" position of the mode switch 62 is selected, the first movable switch 62*a* and second movable switch 62*b* are both turned OFF. As a result, voltage is no longer supplied from the battery 82 to the KEY IN terminal of the controller 86. In response, the controller 86 cuts off the supply of current to the exciting coil 94*b* of the main relay 94, thereby turning the movable switch 94*a* OFF to cut off the supply of voltage from the battery 82 to the motor 28 and stop supply of power by the motor 28. Moreover, as pointed out above, when the second movable switch 62*b* is turned OFF, voltage from the battery 82 is supplied to the ignition coil 106 through the ignition circuit 104. When this condition has been established, the engine 20 can be started by operating the recoil starter.

When the "Motor Power" position of the mode switch 62 is selected, the first movable switch 62*a* and second movable switch 62*b* are both turned ON. As a result, similarly to the foregoing, voltage from the battery 82 is supplied to the KEY IN terminal of the controller 86. In response, the controller 86 turns ON the main relay 94 to operate the motor 28. Further, the switching ON of the second movable switch 62*b* connects the ignition circuit 104 to the ground terminal 110, so that voltage is no longer supplied from the battery 82 to the ignition coil 106, whereby supply of power by the engine 20 is stopped.

When the "Engine & Motor CUTOFF" position of the mode switch 62 is selected, the first movable switch 62*a* is turned OFF and the second movable switch 62*b* is turned ON. As a result, voltage is no longer supplied from the battery 82 to the KEY IN terminal of the controller 86. In response, the controller 86 turns OFF the main relay 94 to stop supply of power by the motor 28. Further, the switching ON of the second movable switch 62*b* connects the ignition circuit 104 to the ground terminal 110, thereby stopping the supply of power by the engine 20.

When the "Motor Power" or "Engine & Motor Power" position is selected, the output of the motor 28 varies in accordance with the signal received from the rotation angle senor 60, namely with the operator's manipulated variable (rotation angle) through the throttle grip 58, thereby regulating the speed of the boat 16.

The operation of the emergency shutdown switch 64 will now be explained. The emergency shutdown switch 64 turns ON when the tab 70 (located on top of the emergency shutdown switch 64 as shown in FIG. 1) is pulled out. The tab 70 is connected to the operator's wrist, for example, through the spiral cord 72. Therefore, if the operator should accidentally fall overboard, the spiral cord 72 will be pulled in the direction that the operator falls. As a result, the tab 70 will be pulled out of the emergency shutdown switch 64, thereby turning the emergency shutdown switch 64 ON.

When the emergency shutdown switch 64 is turned ON, voltage from the battery 82 is supplied to the exciting coil 96*a* of the motor emergency relay 96 to turn ON the movable switch 96*b*. In other words, the EMER SW terminal and EMER GND terminal of the controller 86 are connected. In response, the controller 86 cuts off supply of current to the exciting coil 94*b* of the main relay 94, thereby turning OFF the movable switch 94*a*. The supply of voltage from the battery 82 to the motor 28 is therefore stopped to stop the supply of power by the motor 28.

Turning on the emergency shutdown switch 64 also causes voltage to be supplied to the exciting coil 98*a* of the engine emergency relay 98, thereby turning ON the movable switch 98*b*. As a result, the ignition circuit 104 of the engine 20 is connected to the ground terminal 112, so that voltage from the battery 82 is no longer supplied to the ignition coil 106, thereby stopping supply of power by the engine 20.

As explained in the foregoing, the outboard motor 10 according to this preferred embodiment of the invention is adapted for mounting on the boat 16 and equipped with the engine 20, the electric motor 28, the battery 82 for supplying voltage to the engine 20 and the motor 28, and the controller 86 for controlling the operation of the motor 28, and the controller 86 is disposed near the battery 82. In other words, the controller 86 is not installed on the outboard motor 10 side where the engine 20 and the like are present but on the boat 16 side where the battery 82 is installed. As a result, the effect of the vibration and heat of the engine 20 on the controller 86 is minimized so that the controller 86 can utilize simpler structural features for vibration and heat resistance and is also advantageous in terms of cost.

Moreover, the mounting layout freedom of the controller 86 is enhanced because space is less restricted on the boat side where the battery 82 is installed than inside the outboard motor 10.

In addition, the battery box 76 for accommodating the battery 82 and controller 86 is installed in the boat 16, i.e., the controller 86 is accommodated in the battery box 76 located in the boat 16. Thanks to this configuration, the likelihood of the controller 86 being exposed to water is lower than in the conventional arrangement of installing the controller inside the outboard motor, so that the waterproofing structure of the controller 86 (more exactly, the controller case 88 housing the controller 86) can be simple, i.e., a simplified waterproofing structure suffices, and the shock resistance against external impact can also be enhanced.

The battery box 76 is made removable from the boat 16. Owing to this configuration, the operator or a maintenance person can remove the battery box 76 housing the battery 82 from the boat 16 and easily carry it to a facility on land when the battery 82 requires charging or servicing.

The peripheral equipment connected to the controller 86 (comprising the main fuse 90, sub-fuses 92, main relay 94, motor emergency relay 96 and engine emergency relay 98) is attached to the battery 82, i.e., the peripheral equipment is, like the controller 86, disposed on the boat 16 side. Owing to this configuration, the cables for connecting the controller 86 and the peripheral equipment are strung on the boat 16 side, so that when the outboard motor 10 is mounted on or dismounted from the boat 16, no need arises for connecting or disconnecting these cables, and it suffices to connect or disconnect only the cables 102 between the outboard motor 10 and the equipment on the boat side (the battery 82 etc.). The work of mounting the outboard motor 10 is therefore made simple.

The main fuse 90 and sub-fuses 92 are connected to the battery 82. Owing to this configuration, the unfused circuit portions from the battery 82 to the main fuse 90 and sub-fuses 92, i.e., the portions susceptible to overcurrent, can be reduced to the very minimum to improve the reliability of the outboard motor 10.

The controller 86 is attached to the surface 82*a* of the battery 82 and the peripheral equipment is attached to the surface 82*b* on the opposite side, i.e., the controller 86 and peripheral equipment are attached to the left and right sides 82*a*, 82*b* so as to keep the weight of the battery 82 in balance. This configuration makes it easy for the operator to carry the battery box 76 housing the battery 82.

The external connectors 100 are attached at the upper surface of the battery 82, i.e., at the upper surface of the battery box 76. Owing to this configuration, the cables 102 between the outboard motor 10 and the equipment on the boat side can be easily connected and disconnected without using a tool.

The emergency shutdown switch 64 is provided for stopping supply of power by the engine 20 and motor 28, which constitute power sources for the propeller 50. Owing to this configuration, even in the case of the outboard motor (hybrid outboard motor) 10 equipped with multiple power sources, it is possible to stop the supply of power by all power sources without providing multiple emergency shutdown switches, namely, by use of the single emergency shutdown switch 64. As a result, it suffices for the operator to attach the single emergency shutdown switch 64 to the wrist via the spiral cord 72, which is easy to do.

As only one spiral cord 72 is needed, there is no risk of the spiral cords getting tangled and interfering with operation of the outboard motor 10. The operator can therefore operate the outboard motor smoothly.

The emergency shutdown switch 64 is equipped with at least two sets of contacts (specifically, the motor emergency relay 96 and engine emergency relay 98) and the at least two sets of contacts are interposed in the power supply circuits of the engine 20 and motor 28 (the ignition circuit 104 of the engine 20 and the power circuit of the controller 86). Owing to this configuration, the structure becomes simpler, namely the supply of power by the engine 20 and motor 28 can be reliably stopped by closing two sets of contacts, more exactly by merely turning ON the two sets of contacts.

The embodiment is thus configured to have an outboard motor (10) mounted on a stern of a boat (16) and having an internal combustion engine (20) and a propeller (50) to be powered by the engine to propel the boat, comprising: an electric motor (28) installed to be operable to rotate the propeller; a battery (82) installed in the boat for supplying voltage to the engine and the electric motor; and a controller (electronic control unit) (86) installed at a position near the battery for controlling operation of at least one of the engine and the electric motor. Specifically, the controller (86) is installed in the boat (16) where the battery (82) is installed for controlling operation of the electric motor (28).

In the outboard motor, the battery (82) and the controller (86) are housed in a watertight box, the watertight box is installed in the boat and is made removable from the boat.

In the outboard motor, a peripheral equipment (electronic circuitry including the main fuse 90, sub-fuses 92, main relay 94, motor emergency relay 96 and emergency relay 98) connected to the controller is attached to the battery.

In the outboard motor, the controller (86) is attached to a surface of the battery (82) and the peripheral equipment is attached to a surface on an opposite side. In the outboard motor, an external connector (100) is attached at an upper surface of the battery.

The outboard motor further includes: an emergency shutdown switch (64) connected to the engine and the electric motor for stopping supply of power by the engine and the electric motor.

In the outboard motor, the emergency shutdown switch (64) is equipped with at least two sets of contacts (relay 96, 98) interposed in power supply circuits of the engine and electric motor.

The outboard motor further includes: a mode switch (62) which an operator can use to input commands for starting and stopping the engine and the electric motor.

It should be noted in the above that, although the embodiment explained in the foregoing uses a DC brushless motor as the electric motor 28, a different type of motor can be used instead.

It should also be noted that, although in the foregoing the engine 20 is said to have a displacement of about 50 cc, the electric motor 28 to have an output of several hundred Watts, and the battery box 76 to be made of a resin material, these values and material are non-limitative examples.

It should further be noted that, although the centrifugal clutch 36 is said to be installed between the engine 20 and motor 28, an electromagnetic clutch or the like can be used instead.

Japanese Patent Application No. 2005-114864 filed on Apr. 12, 2005, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An outboard motor mounted on a stem of a boat and having an internal combustion engine and a propeller to be powered by the engine to propel the boat, comprising:

an electric motor installed to be operable to rotate the propeller;

a battery installed in the boat for supplying voltage to the engine and the electric motor; and a controller attached to a surface of the battery for controlling operation of at least one of the engine and the electric motor.

2. The outboard motor according to claim 1, wherein the controller is installed in the boat where the battery is installed for controlling operation of the electric motor.

3. The outboard motor according to claim 1, wherein the battery and the controller are housed in a watertight box.

4. The outboard motor according to claim 3, wherein the watertight box is installed in the boat.

5. The outboard motor according to claim 4, wherein the watertight box is made removable from the boat.

6. The outboard motor according to claim 1, wherein peripheral equipment connected to the controller is attached to the battery.

7. The outboard motor according to claim 6, wherein the peripheral equipment is attached to a surface of the battery on an opposite side of the battery relative to the controller.

8. The outboard motor according to claim 1, wherein an external connector is attached at an upper surface of the battery.

9. The outboard motor according to claim 1, further including:

an emergency shutdown switch connected to the engine and the electric motor for stopping supply of power by the engine and the electric motor.

10. The outboard motor according to claim 9, wherein the emergency shutdown switch is equipped with at least two sets of contacts interposed in power supply circuits of the engine and electric motor.

11. The outboard motor according to claim 1, further including:

a mode switch which an operator can use to input commands for starting and stopping the engine and the electric motor.

12. The outboard motor according to claim 1, wherein the controller comprises a processor and power circuitry.

13. The outboard motor according to claim 6, wherein the peripheral equipment comprises at least one of a relay and a fuse.

14. The outboard motor according to claim 1, wherein an external connector is attached at an upper surface of the battery, the battery is housed in a watertight box, and the connector extends through an opening in the box.

15. The outboard motor according to claim 1, further including:

a mode switch which an operator can use to input commands for starting and stopping the engine and the electric motor, the mode switch capable of being switched between plural operating modes, the plural operating modes comprising engine only operation, motor only operation, engine and motor operation, and power off.

16. An outboard motor mounted on a stem of a boat and having an internal combustion engine and a propeller to be powered by the engine to propel the boat, comprising:

an electric motor installed to be operable to rotate the propeller;

a battery installed in the boat for supplying voltage to the engine and the electric motor;

a controller adapted to control operation of at least one of the engine and the electric motor; and peripheral equipment connected to the controller, wherein the controller is attached to a surface of the battery, and the peripheral equipment is attached to a surface of the battery on an opposite side of the battery relative to the controller.

* * * * *

UNITED STATES PATENT AND TRADEMARK OFFICE

CERTIFICATE OF CORRECTION

PATENT NO. : 7,195,525 B2
APPLICATION NO. : 11/402116
DATED : March 27, 2007
INVENTOR(S) : Watabe et al.

It is certified that error appears in the above-identified patent and that said Letters Patent is hereby corrected as shown below:

Column 9

Claim 1, line 1 change "stem" to -- stern --

Column 10

Claim 16, line 1, change "stem" to -- stern --

Signed and Sealed this

Nineteenth Day of June, 2007

JON W. DUDAS
*Director of the United States Patent and Trademark Office*